United States Patent [19]

Madachy

[11] 4,201,352

[45] May 6, 1980

[54] METHOD AND COMBINATION FOR WINDING STRANDS OF WEB MATERIAL HAVING VARYING THICKNESSES ON A TAKE-UP DRUM

[75] Inventor: John F. Madachy, Mayfield Heights, Ohio

[73] Assignee: Loopco Industries, Inc., Twinsburg, Ohio

[21] Appl. No.: 945,210

[22] Filed: Sep. 25, 1978

[51] Int. Cl.[2] ..... B65H 35/02; B65H 23/10

[52] U.S. Cl. ..... 242/56.2; 242/75; 242/75.2

[58] Field of Search ..... 242/75, 75.2, 75.3, 242/75.5, 56.2, 56.7, 67.1 R, 67.3 R, 78.1

[56] References Cited

U.S. PATENT DOCUMENTS

| | | | |
|---|---|---|---|
| 3,046,823 | 7/1962 | Cole | 242/56.2 |
| 3,672,595 | 6/1972 | Jablin | 242/56.2 |
| 3,815,839 | 6/1974 | Madachy | 242/72 |
| 3,863,857 | 2/1975 | Smith | 242/72 B |
| 4,093,140 | 6/1978 | Matsunaga | 242/56.2 |
| 4,093,141 | 6/1978 | Garrett | 242/56.2 |

*Primary Examiner*—Edward J. McCarthy
*Attorney, Agent, or Firm*—John H. Mulholland

[57] ABSTRACT

A method and combination for eliminating slack in one or more of a plurality of strands of web material being wound into coils on a take-up drum, where the strands have different thicknesses, include connecting a portion of each strand to the drum so that rotation of the drum will cause the strands simultaneously to wind onto the drum. The strands are wound onto the drum and a portion of each strand is connected to a previously wound portion of the same strand for forming a plurality of fixed diameter loops about the drum, the portion of each strand adjacent to the drum substantially conforming in size and shape to the outer surface of the drum. The portion of each strand connected to the drum is disconnected and the outer diameter of the drum is reduced an amount sufficient to cause the loops to slip relative to the drum when the drum is rotated and a predetermined tension is reached in the strands, the frictional force between the strands and drum causing the loops to rotate with the drum until said predetermined tension is reached.

25 Claims, 6 Drawing Figures

METHOD AND COMBINATION FOR WINDING STRANDS OF WEB MATERIAL HAVING VARYING THICKNESSES ON A TAKE-UP DRUM

BACKGROUND OF THE INVENTION

This invention relates to the art of slitting a web of sheet steel into a plurality of strips and winding them onto a rotatable take-up drum and, more particularly, to a method for eliminating undue slack in the strips as they are wound into uniformly tight coils on the drum.

The problem solved by the present invention is caused by the fact that when rolled sheet steel is formed in a rolling mill the sheets are not perfectly flat but are slightly convex so that the center of the sheet is thicker than the edges. This causes problems in conventional slitting operations where the sheets in the form of rolls are unwound and slit or cut into a number of adjacent strips which are then wound into coils on a take-up or recoiling drum. One such drum which has a selectively expansible and contractable outer surface for easy removal of the coils is the subject of U.S. Pat. No. 3,815,839, which issued June 11, 1974 to the owner of the instant invention and has the same inventor. The subject matter of that patent is hereby incorporated by reference as though it were fully set forth herein.

The problem caused by the varying thicknesses of the strips is that since all of the strands are rolled onto a single drum the coils at the outer ends tend to be looser than the ones in the middle where the strips are thicker. Loose coils are harder to band together and palletize and are dangerous to handle because if they are dropped they can uncoil violently like a giant spring.

These problems could possibly be solved by winding each strip on its own take-up drum so that the rotational velocity of the drums could be individually adjusted to maintain the tension in the strips within an acceptable range. This alternative, however, would be prohibitively expensive and impractical for commercial operations.

Attempts to solve the problem have been made by providing a tensioning mechanism between the slitting mechanism and the take-up drum so that a uniform tension can be maintained in the strips as they are rolled onto the drum. Although this solution eliminates the loose coil problem, slack is created in the portion of the outer strands upstream from the tensioning mechanism, which can result in loops being formed in the outermost strips extending ten feet or more below the normal line of travel. It has been found that a pit or large vertical clearance is necessary to accommodate the loops.

Where a tensioning mechanism and accompanying pit or vertical clearance are impractical, the prior art teaches that a paper stuffer can be effective in eliminating the slack. The paper stuffer is a machine which interleaves a strand of paper in selected portions of the coil as it is being wound around the take-up drum to compensate for the smaller thickness of the outermost strips and provide a tightly wound coil.

Each of these alternatives, although workable, has proved to be economically detrimental to full realization of the commercial potential of a slitting operation. Further, formation of the loops when slack is created and the paper stuffer machine are potentially dangerous to workers. More particularly, an independently rotatable drum for each strip is obviously a prohibitively expensive alternative. The utilization of a separate tensioning mechanism and the space required for a pit or vertical clearance have been used, but they add noticeably to the expense of the slitting operation. Loops in the steel strips which extend ten feet or more below the normal line of travel are subject to unpredictable movement, which increases the danger of working near the slitting equipment. The paper stuffer is another piece of expensive equipment and must be located in close proximity to the takeup drum so that workers who are servicing or otherwise working near the stuffer expose themselves to the hazards of the moving steel strips.

SUMMARY OF THE INVENTION

The problems discussed above have been minimized or solved by the invention which will be described in detail below. The invention is directed to a method for winding a plurality of separate strips onto a recoiler or take-up drum which has a selectively variable outer diameter and operates to eliminate slack in the outer strips while maintaining substantially uniform tension in all of the strips.

The lead ends of the strips are gripped by or otherwise connected to the recoiler or take-up drum so that rotation of the drum will cause the strips simultaneously to wind onto the outer surface of the drum to form coils as mentioned above. As the drum rotates a portion of each strip tangential to the drum is connected to a previously wound portion of the same strip to form a fixed diameter loop around the drum which conforms substantially to the size and shape of the outer surface of the drum. This can be done by providing a double-faced adhesive tape along the outer surface of the first winding around the drum so that after the first complete revolution the tape will adhere to the inner surface of the next winding to form the loop. That the loops have a fixed diameter is important for the reasons mentioned below.

After the loop is formed, slack which forms in the unwound portions of any of the strips can be eliminated as follows. The lead end of the strips is disconnected from the drum and the outer diameter of the drum is reduced by a small amount. If a drum of the type described in U.S. Pat. No. 3,815,839 is used these steps will be performed simultaneously.

Contraction of the drum is regulated so that frictional contact is maintained between the fixed diameter loops and the drum to pull the loose strands tight to the point where the tension in each of the strands is substantially the same. When the strands reach this predetermined optimum tension, and for the strands in which there is no slack this condition will be achieved immediately, the friction between the inner surface of the loop and the drum is low enough so that the loops will slip relative to the drum. The loops have a fixed diameter so that the strips will not "cinch up" or tighten around the drum. After the slack is removed from all of the strips the drum is expanded back to its initial diameter to prevent any further slippage between the loops and drum for winding all the strips into coils. The process is then repeated whenever an undue amount of slack is created in any of the strips.

It is therefore an object of the invention to utilize a single take-up drum for coiling a plurality of strips and minimize the need for additional equipment and material to provide uniformly tight coils.

Another object of the invention is to utilize a combination of conventional equipment and material for eliminating the problems discussed above.

Another object of the invention is to utilize an expansible and contractable take-up drum and double-faced adhesive tape for regulating frictional contact between a loop formed in the strip being wound and the outer surface of the drum for eliminating slack in the strip.

Yet another object of the invention is to use double-faced adhesive tape to prevent the shorter strips from cinching up and tightening on the drum after the lead end of the strip is disconnected from the drum.

BRIEF DESCRIPTION OF THE DRAWINGS

These and other objects and advantages of the invention will become apparent from the following detailed description of a preferred embodiment when taken in conjunction with the accompanying drawings in which.

DETAILED DESCRIPTION OF A PREFERRED EMBODIMENT

Figure 1:
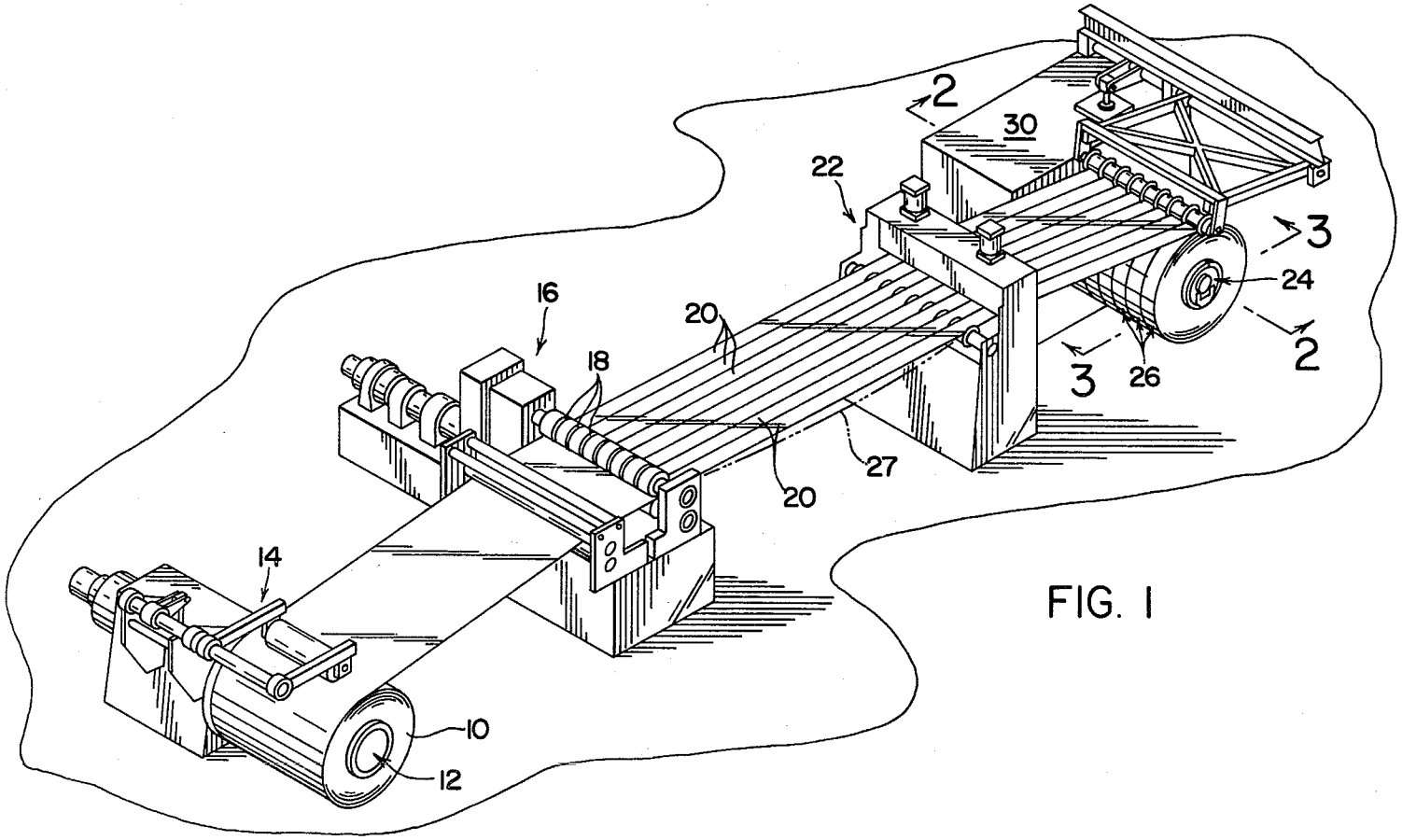
FIG. 1 is a perspective view of an apparatus used for slitting a web of sheet metal into a plurality of strips and winding those strips into coils on a recoiler or take-up drum.

Referring to FIG. 1, a conventional sheet steel slitting operation in which the present invention can be practiced will be described in detail. Reference numeral 10 is used to refer to a roll of sheet steel which is mounted for rotation about a roller 12. A braking mechanism generally referred to by reference numeral 14 is used to control the rate at which the sheet metal can be removed from the roll 10.

A slitter or slitting mechanism 16 is located downstream from the roll 10, which includes a pair of rotatable knives 18 located on opposite sides of the sheet metal for each slit. The knives can be rotated by the metal sheet or, as in the case of the mechanism 16, be driven by their own motor. The knives 18 operate to slit the web of sheet metal as it unrolls from the roll 10 into a plurality of strips 20 which travel through a tension stand as known in the slitting art or tensioning mechanism generally referred to by reference numeral 22 and then are wound onto a recoiler or motor-driven take-up drum 24 into a plurality of separate coils 26.

The tensioning mechanism 22 is provided because when the steel sheets are formed in a rolling mill the sheets have a slightly greater thickness in the middle than on the ends. The tensioning mechanism 22 maintains a substantially equal tension in each strip 20 as it is being wound onto the take-up drum 24 to prevent loose coils from forming where the strands are thinner. As a result of the tensioning mechanism 22 maintaining substantially equal tension in the strips 20 even though they vary in thickness, the thicker strips 20 will be wound faster than the thinner ones. This results in the thinner outer-most strands having slack created in them as shown by broken line 27 in FIG. 1. The subject invention is directed to minimizing or eliminating these slack portions.

The take-up drum 24, which is part of the conventional slitting operation and shown in detail in FIGS. 2–6, is in the form of an expansible and contractable drum assembly which includes a generally cylindrical center shaft 28, cantileverly mounted in or from a main support 30. The drum 24 is described in detail in U.S. Pat. No. 3,815,839, mentioned above, but a detailed description of the drum 24 will be provided to facilitate complete understanding of the present invention.

Figure 3:
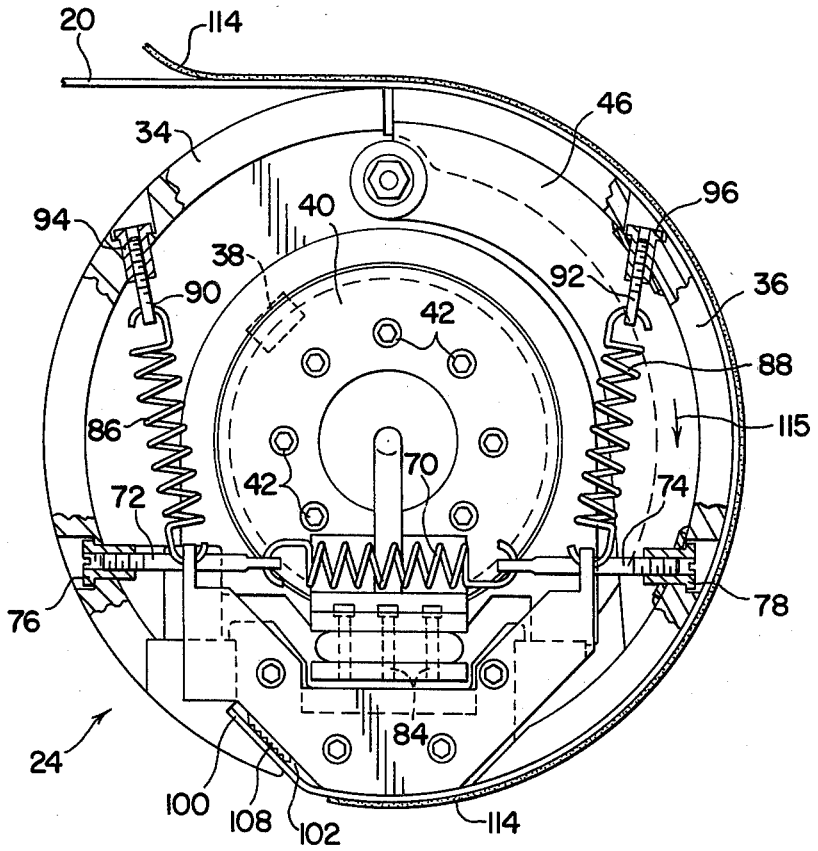
FIG. 3 is an end view of the take-up drum of FIG. 2 looking along line 3—3 in FIGS. 1 and 2 and showing in particular gripping means gripping the lead end of a strip of sheet metal and the double-faced tape used to form a fixed diameter loop around the drum.
Figure 4:
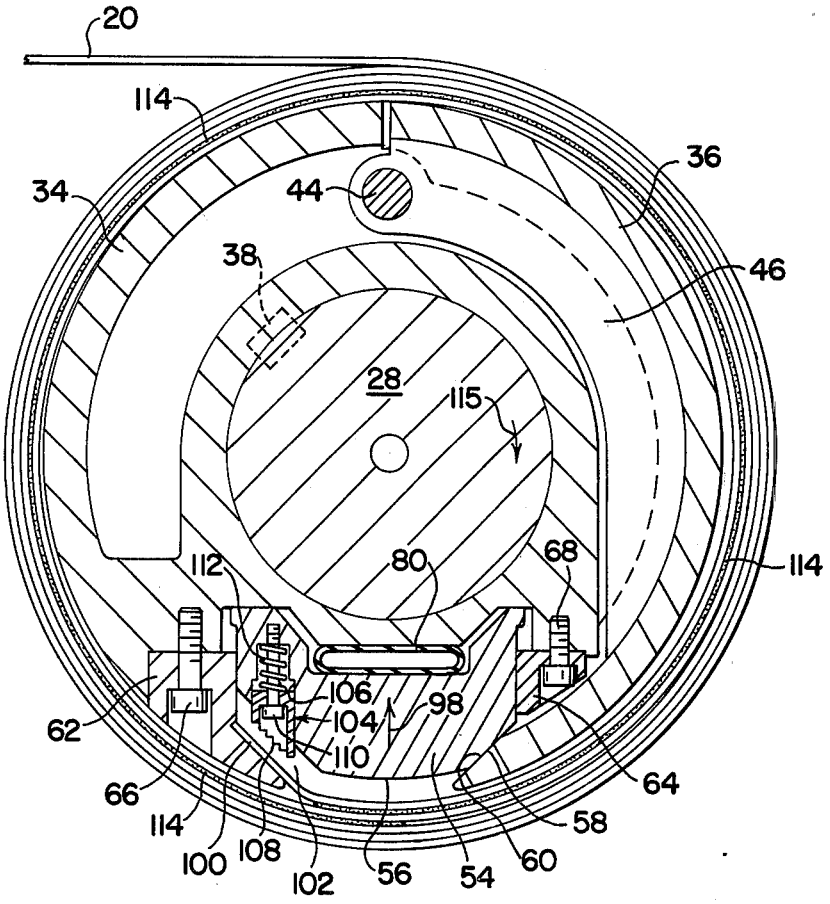
FIG. 4 is a sectional view of the take-up drum looking along the line 4—4 in FIG. 2 and showing in particular the gripping means releasing the lead end of the strip after the loop is formed and the drum being simultaneously contracted.

A pair of first and second elongated shell sections 34 and 36 are carried on the shaft 28 and cooperate to define substantially but not the entire outer winding surface of the drum 24 (see in particular FIG. 4). As shown best in FIG. 4, the shell section 34 is formed separately from but connected rigidly to the shaft 28 by a key 38, although the section 34 and shaft 28 could be formed as one integral piece. As shown best in FIGS. 2 and 3, a circular retaining plate 40 is connected to the shaft 28 through a plurality of socket screws 42 or the like so that the segment 34 can easily be removed from the shaft 28.

The drum 24 is designed so that its outer circumference can selectively be contracted or expanded so that the coils 26 can easily be removed from the drum. This expansion and contraction capability is also used to practice the invention as is described in detail below.

The expansion and contraction of the drum 24 is provided by pivotally mounting the shell section 36 on a shaft 44 which extends longitudinally through the drum 24 and is mounted on the shell section 34. As shown best in FIGS. 2 and 4, the shaft 44 passes through openings in a plurality of spaced, radially inwardly extending reinforcing ribs 46 which are connected to the back of the shell section 36, and also through openings in web sections 48 which are integrally formed with the shell section 34. A plurality of set screws 50 are provided in the web sections 48 to engage the shaft 44 and prevent it from rotating relative to the shell section 34, but the openings in the ribs 46 are sized so that the shaft 44 can rotate relative to the shell section 36. A pair of collars 52 are mounted at each end of the shaft 32 for holding the shell section 36 in place.

The shell section 36 is accordingly mounted so that it can oscillate about the shaft 44 relative to the shell section 34 between the expanded position shown in FIG. 3 and the collapsed or contracted position shown in FIG. 4. For this reason the shell sections 34 and 36 should each have a circumferential extent less than 180° so the outer diameter of those sections can effectively be contracted to less than the inner diameter of the coils 26.

The drum 24 is also provided with means for selectively actuating the shell section 36 which, in this embodiment of the drum, is combined with the means for gripping the lead end of the metal strip and holding it in place. However, the subject invention can be practiced using expandable drums where those two functions are performed separately.

Figure 2:
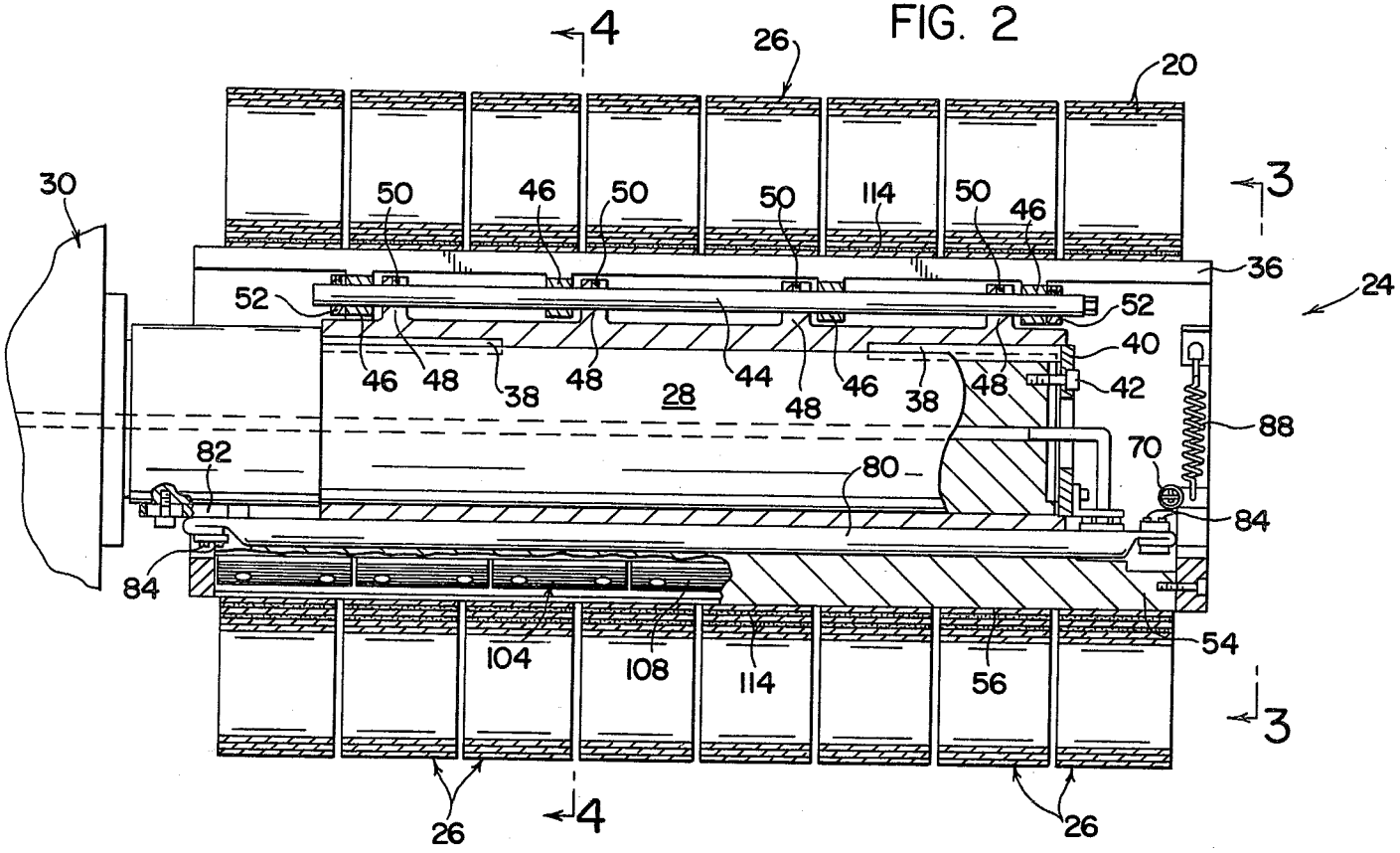
FIG. 2 is a longitudinal sectional view of the take-up drum of FIG. 1 looking along line 2—2 in FIG. 1.

Referring in particular to FIGS. 2 and 4, an actuating member 54 is carried in the lower portion of the drum 24 and extends longitudinally along its full length. The actuating member 54 is formed of a relatively rigid metal bar which is mounted for radial reciprocation relative to the axis of the drum 24 and which includes an outer surface 56 which is shaped to form a continuation of the outer winding surface defined by the shell sections 34 and 36. The actuating member 54 also includes a cam surface 58 which engages a cooperating inclined surface 60 located on the inner portion of the shell section 36 for controlling movement of the shell section 36. The actuating member 54 is held in place by means of a pair of guide blocks 62 and 64 which are releasably connected to the shell section 34 by means of socket screws 66 and 68, respectively, or the like.

The shell section 36 is biased radially inward by a tension spring 70 (see FIG. 3) connected between the shell sections 34 and 36 through a pair of studs 72 and 74, respectively, the outer ends of which are threaded and received in flanged collars 76 and 78, respectively, for adjusting the tension in the spring 70. In this way the spring 70 maintains a constant inward bias on the shell section 36 which must be overcome in order to move the section 36 outward for expanding the drum 24.

The actuating member 54 is moved radially inward and outward to regulate the outer diameter of the drum 24. This is done through an hydraulic actuator arrangement which includes a hose member 80 which is folded over and connected to a plate 82 carried on an enlarged diameter portion of the center shaft 28. The hose 80 is folded over at each end and held in place by machine screws 84 or the like. In the illustrated embodiment, hydraulic fluid under pressure is supplied to the hose 80 for expanding it and causing the actuating member 54 to move outward, overcoming the force of the spring 70 which in turn causes the shell section 36 to move outwardly and expand the diameter of the drum 24.

As shown best in FIGS. 2 and 3, a pair of tension springs 86 and 88 connected between the actuating member 54 and the shell segments 34 and 36, respectively, bias the actuating member 54 inwardly so that the force exerted by the springs 86 and 88 must be overcome before the shell section 36 can be caused to move outwardly as described above. The springs 86 and 88 are connected to the shell segments 34 and 36, respectively, through threaded studs 90 and 92, respectively, which are received by flanged sleeve members 94 and 96, respectively, located in the shell segments so that the spring tension can easily be adjusted. Thus, when the hydraulic pressure in the hose 80 is released the hydraulic member 54 will automatically move radially inward as shown by the arrow 98 in FIG. 4. At the same time the spring 70 will cause the shell segment 36 also to move inwardly which effectively contracts the outer diameter of the take-up drum 24.

The actuating member 54 also carries a gripping mechanism for connecting the lead end 100 of each of the strips 20 to the take-up drum 24. The gripping mechanism includes a slot 102 formed along the length of the drum between the actuating member 54 and the guide block 62. A plurality of gripper jaws 104 spaced along the drum 24 are slidably received in slot 106 which extends along the actuating member 54 adjacent to the slot 102. Each gripper jaw 104 includes a serrated inclined edge 108. The gripper jaws 104 are maintained in the slot 106 by means of shoulder screws 110 which engage suitable tapped openings formed in the bottom of the groove 106. Compression springs 112 are provided for biasing the gripper jaws 104 outwardly. Thus, when the actuating member 54 is moved outwardly to expand the drum 24 the gripper jaws 104 will also move outwardly and engage the lead end 100 of the strip 20 and clamp it firmly against the guide block 62. The springs 112 allow individual variations in the positions of the gripper jaws 104 to compensate for thickness differences in the various strips 20.

It should be noted, however, that for the purposes of the instant invention the gripping mechanism described above is only one alternative which may be used and that other means can be used releasably to connect the strands 20 to the drum 24, such as, for example, those which utilize magnetic or vacuum actuated gripping capabilities. It should also be noted that the drum which has just been described in detail is not the only one which can be used to practice the invention, but that other types of drums with a selectively expandable and contractable outer surface could also be used.

In practice, the lead end 100 of each strip 20 is inserted into the slot 102 and the actuating member 54 is caused to move outwardly so that the serrated edge 108 will engage the lead end 100 and clamp it firmly in place as shown in FIG. 3. The take-up drum 24 is then rotated so that the strip 20 will be wound around the drum 24.

In accordance with the invention the first few windings are formed into a fixed diameter loop around the drum 24. One way of forming such a loop is to place a double-faced tape 114 over the outer surface of the first winding of the strand 20 as shown in FIG. 3. A double-faced tape is one which has adhesive on both sides so that after one winding is completed, the double-faced tape 114 will become interleaved between the first and second windings and adhere both to the outer surface of the first winding and the inner surface of the second winding as shown in FIG. 4. A fixed loop is thereby formed which will prevent the loop from tightening or cinching-up around the drum 24 when it is rotated in the direction of the arrow 115 and the outer diameter of the drum is contracted, the importance of which will become apparent from the following discussion.

While the strands 20 are being wound around the drum 24 to form the coils 26, the tensioning mechanism 22 operates to provide a substantially equal tension in the portion of the strands 20 which are wound onto the drum 24. Since, as described in detail below, some of the strands 20 are not as thick as the other strands slack will be created in the portion of those thinner strands between the cutting mechanism 16 and the tensioning mechanism 22 is indicated by the broken line 27.

When the slack is sufficient enough that an adjustment needs to be made, hydraulic fluid is removed from the tube 80, which results in the actuating member 54 moving inwardly toward the axis of the drum 24, causing the shell segment 36 to pivot inwardly about the axis of the rod 44 and reduce the diameter of the drum 24. At the same time, the serrated edges 108 of the gripping mechanism will become disengaged from the lead ends 100 of the strips 20 so that they no longer are connected to the drum 24.

At the same time the drum 24 must be rotated at a speed such that the strips 20 are being wound around the drum 24 at a rate greater than the rate at which the material is being unwound from the roll 10. This can be done by increasing the rotational velocity of the drum 24, increasing the drag on the roll 10 through the braking mechanism 14 or a combination of both actions.

Figure 5:
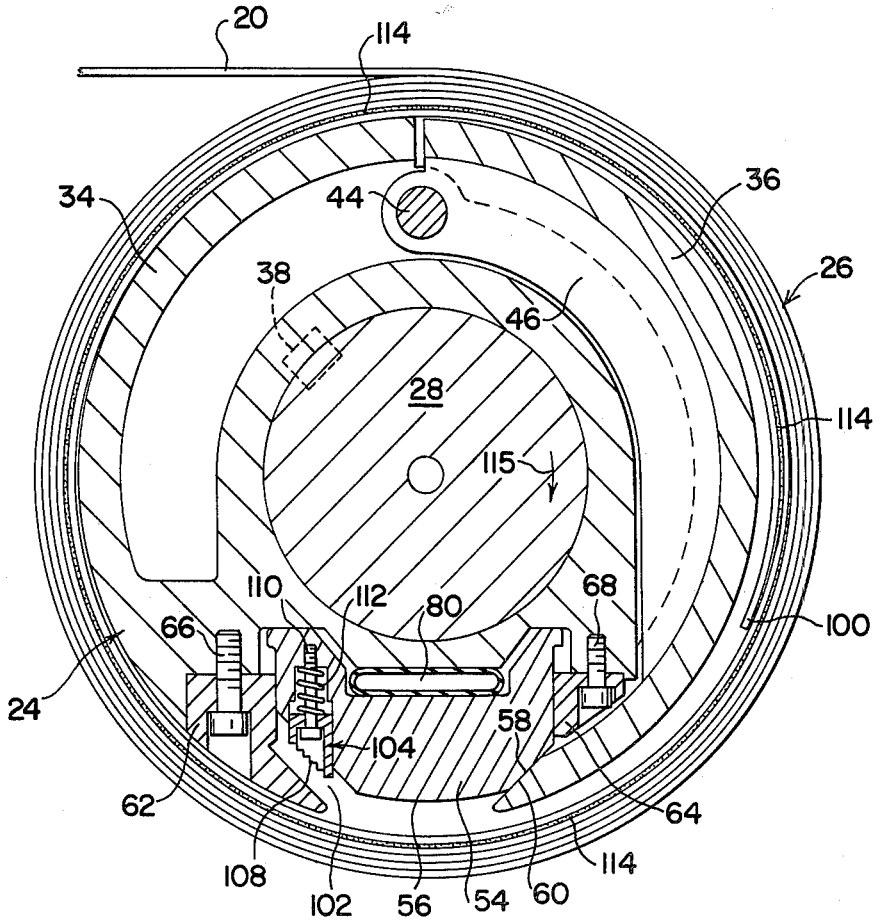
FIG. 5 is a sectional view similar to that of FIG. 4, but showing that the loop has rotated relative to the outer surface of the drum.
Figure 6:
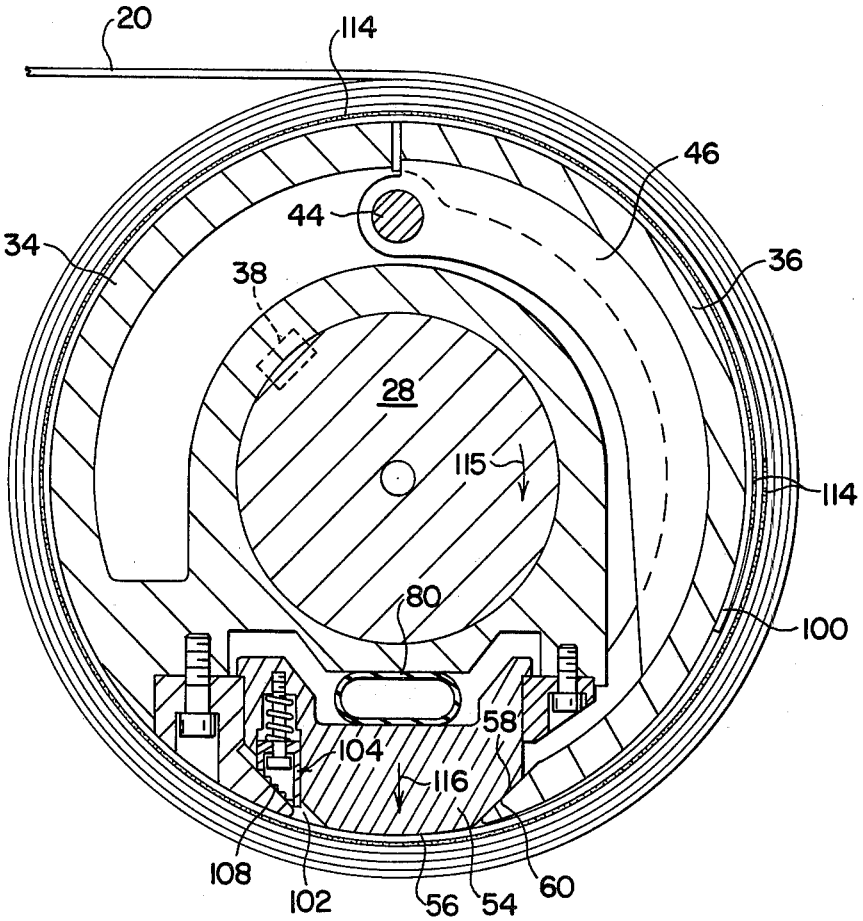
FIG. 6 is a cross-sectional view similar to that of FIG. 5 with the outer diameter of the take-up drum expanded back into its original size.

The amount of contraction of the drum 24 is regulated so that for the strips 20 in which there is little or no slack, the tension in the strip 20 caused by the greater rate by which the drum 24 is pulling on the strips 20 will overcome the frictional force between the reduced-diameter drum 24 and the fixed-diameter loop so that the loop will slip relative to the drum 24, thereby causing the lead end 100 to withdraw from the slot 102 as shown in FIG. 5. For a conventional drum, a contraction of from 1/16"–⅛" on the diameter has been found to be sufficient.

At the same time, for those strips 20 in which slack has been created the drum 24 and loop will continue to rotate together since the tension in those strips 20 is not great enough to overcome the frictional force between the outer surface of the drum 24 and the inner surface of the loop. Once the slack has been eliminated, tension in the strip 20 will become great enough to cause the loops for those strips to slip as described above.

When the slack in all of the strips 20 has been eliminated, normal operation is resumed, e.g. the relative drum velocity and rate at which the roll 10 is unwound are returned to normal. Hydraulic fluid is once again introduced into the hose 80 causing the actuating member 54 to move outwardly in the direction of the arrow 116 so that the outer surface of the drum 24 will engage the loop and create a frictional force sufficient to begin winding all of the strips 20 into the coils 26.

As can be seen, the fact that the loop is formed with a fixed diameter will prevent the loop from tightening or cinching-up about the outer surface of the drum 24 so that for the strips 20 in which there is no slack the drum 24 will rotate relative to the loops.

Conventional winding of the coils 26 is then continued until enough slack is detected in the strips 20 to repeat the operation once again. The method lends itself both to manual operation where an operator detects the slack and makes appropriate adjustments and to automatic operation with appropriate sensors and switching mechanisms being provided to carry out the operation as described above.

As can be seen, the invention reduces or eliminates the need to provide a pit or large vertical clearance to accommodate any slack which might occur while the strands 20 are being wound into coils 26. Additional equipment such as a paper stuffer for interleaving paper in the coils so that they are not wound too loosely can be eliminated. Potential dangers to workers caused by extraordinarily large loops or the need to operate additional equipment such as the paper stuffer are also eliminated.

The embodiment of the invention described above is intended to be merely exemplary and those skilled in the art will be able to make modifications and variations without departing from the spirit and scope of the appended claims. All such modifications and variations are contemplated as falling within the scope of the claims.

I claim:

1. A method for eliminating slack in one or more of a plurality of strands of web material being wound into coils on a take-up drum, where the strands have different thicknesses, comprising the steps of:

(a) connecting a portion of each strand to the drum so that rotation of the drum will cause the strands simultaneously to wind onto the drum;

(b) winding the strands onto the drum;

(c) connecting a portion of each strand to a previously wound portion of the same strand for forming a plurality of fixed diameter loops about the drum, the portion of each strand adjacent to the drum substantially conforming in size and shape to the outer surface of the drum;

(d) disconnecting the portion of each strand connected to the drum; and (e) reducing the outer diameter of the drum an amount sufficient to cause the loops to slip relative to the drum when the drum is rotated and a predetermined tension is reached in the strands, the frictional force between the strands and drum causing the loops to rotate with the drum until said predetermined tension is reached.

2. The method of claim 1, and further including the steps of maintaining in the portions of the strands being wound onto the drum a substantially uniform tension which is lower than said predetermined tension and winding the strands onto the drum at a rate greater than the rate at which the strands are being fed to the drum when the outer diameter of the drum is reduced.

3. The method of claim 2, wherein the step of maintaining a substantially uniform tension includes placing means for tensioning said strands between a feed roll of said web material and the drum.

4. The method of claim 2, wherein the step of winding in claim 3 includes increasing the rotational velocity of the drum.

5. The method of claim 3, wherein the step of winding in claim 3 includes reducing the rotational velocity of the feed roll.

6. The method of claim 1, wherein step (a) incudes connecting the lead end of each strand to the drum.

7. The method of claim 1, wherein step (b) includes rotating the drum.

8. The method of claim 1, wherein step (c) includes forming a fixed loop of at least the first two windings about the drum.

9. The method of claim 8, wherein a length of material with adhesive on both sides is interleaved betwen at least the first two windings.

10. The method of claim 6, wherein step (d) includes releasing the lead end of each strand.

11. The method of claim 1, wherein steps (d) and (e) are performed simultaneously.

12. The method of claim 1, and further including the step of expanding the drum back to its original diameter when said predetermined tension is reached in all of the strands and repeating step (e) when slack is to be eliminated from one or more strands.

13. A method for eliminating slack in one or more of a plurality of strands of web material formed by slitting a web of sheet material which is unwound from a feed roll, where the sheet material has a non-uniform lateral thickness and the strands are being wound into coils on an expansible and contractable take-up drum, comprising the steps of:

(a) winding the strands onto the drum in its expanded condition at the same rate the sheet material is being fed from the feed roll and maintaining a substantially uniform tension in the portions of the strands downstream from the slitting operation as the strands are being wound;

(b) forming a fixed diameter loop from each strand around said drum, the inner surface of the loops conforming substantially in size and shape to the outer surface of the drum in its expanded condition;

(c) reducing the outer diameter of the drum an amount where frictional contact between the loop and drum will cause the loop to rotate with the drum, but which will cause the loop to slip relative to the drum when a predetermined tension in the strands is reached which is greater than said uniform tension; and (d) reducing the rate the web material is being fed from the feed roll relative to the rate the strands are being wound onto the drum.

14. The method of claim 13, wherein prior to step (a) the lead ends of the strands are connected to the drum.

15. The method of claim 14, wherein said lead ends are disconnected simultaneously with step (c).

16. The method of claim 13, wherein step (b) includes interleaving a length of material with adhesive on both sides between at least the first two windings of the strands about the drum.

17. The method of claim 13, wherein steps (c) and (d) are performed substantially at the same time.

18. The method of claim 13, wherein step (d) includes increasing the rotational velocity of the drum.

19. The method of claim 13, wherein step (d) includes reducing the rotational velocity of the feed roll.

20. The method of claim 13, and further including the step of expanding the drum back to its original diameter when said predetermined tension is reached in all of the strands and repeating steps (c) and (d) when slack is to be eliminated from one or more strands.

21. A combination for eliminating slack in one or more of a plurality of strands of web material of different thicknesses as the strands are being wound onto a take-up drum, comprising:

(a) means for connecting and disconnecting a portion of each strand to the drum;

(b) means for rotating the drum for winding the strands onto the drum;

(c) means for connecting a portion of each strand to a previously wound portion of the same strand for forming a plurality of fixed diameter loops about the drum, the portion of each strand adjacent to the drum substantially conforming in size and shape to the outer surface of the drum;

(d) means for maintaining a substantially uniform tension in said strands as they are wound onto the drum;

(e) means for selectively reducing the outer diameter of the drum an amount sufficient to cause the loops to slip relative to the drum when the drum is rotated and a predetermined tension greater than said uniform tension is reached in the strands, the frictional force between the strands and drum causing the loops to rotate with the drum until said predetermined tension is reached; and (f) means for regulating the rate the strands are wound onto the drum relative to the rate at which the strands are being fed to the drum so that winding rate can be adjusted to be greater than the feed rate.

22. The combination of claim 21, wherein said connecting and disconnecting means includes means for gripping the lead end of each strand.

23. The combination of claim 22, wherein the gripping means and drum diameter reducing means include a hydraulically actuated member movable radially relative to the drum axis, a plurality of gripping jaws mounted on said member cooperating with a portion of the drum for gripping said strands.

24. The combination of claim 21, wherein the connecting means includes a length of material with adhesive on both sides being interleaved between at least the first two windings of said strands.

25. The combination of claim 21, and further including means for selectively expanding the drum back to its original diameter.

* * * * *